US007659853B2

(12) United States Patent
Chen et al.

(10) Patent No.: US 7,659,853 B2
(45) Date of Patent: Feb. 9, 2010

(54) MINIATURIZED MULTI-BAND ANTENNA

(75) Inventors: Yun-Ta Chen, Tao-Yuan (TW); Chien-Pang Chou, Tao-Yuan (TW); Chang-Hao Hsieh, Tao-Yuan (TW); Chia-I Lin, Tao-Yuan (TW)

(73) Assignee: HTC Corporation, Taoyuan, Taoyuan County (TW)

( * ) Notice: Subject to any disclaimer, the term of this patent is extended or adjusted under 35 U.S.C. 154(b) by 86 days.

(21) Appl. No.: 11/854,557

(22) Filed: Sep. 13, 2007

(65) Prior Publication Data

US 2008/0186236 A1 Aug. 7, 2008

(30) Foreign Application Priority Data

Sep. 25, 2006 (TW) ..... 95135405 A
Jan. 8, 2007 (TW) ..... 96100709 A

(51) Int. Cl.
*H01Q 1/38* (2006.01)

(52) U.S. Cl. ..... 343/700 MS; 343/702

(58) Field of Classification Search ..... 343/700 MS, 343/702

See application file for complete search history.

(56) References Cited

U.S. PATENT DOCUMENTS 6,342,860 B1 1/2002 Haussler
6,819,287 B2 * 11/2004 Sullivan et al. ..... 343/700 MS
6,930,640 B2 8/2005 Chung et al.
7,352,329 B2 * 4/2008 Chung et al. ..... 343/700 MS
2004/0080457 A1 4/2004 Guo
2004/0090378 A1 5/2004 Dai
2008/0012775 A1 * 1/2008 Shih ..... 343/702
2008/0024371 A1 * 1/2008 Shih ..... 343/702

FOREIGN PATENT DOCUMENTS

| | | | |
|---|---|---|---|
| DE | 103 41 310 | | 3/2004 |
| EP | 1 193 797 | A2 | 4/2002 |
| EP | 1 432 072 | A1 | 6/2004 |
| EP | 1 750 323 | | 2/2007 |
| JP | P2002-111344 | A | 4/2002 |
| WO | 2006/070233 | A1 | 7/2006 |

* cited by examiner

*Primary Examiner*—Tan Ho
(74) *Attorney, Agent, or Firm*—Winston Hsu

(57) ABSTRACT

A multi-band antenna includes a bent flat copper antenna forming a radiation surface to provide GSM-850/900/1800/1900 or GPS multi-band applications, and an auxiliary antenna coupled to the radiation surface provide WCDMA-2100/UMTS-2100 multi-band applications. The radiation surface and the auxiliary antenna are coupled to generate the required bandwidth for multiple radiation bands and to optimize the gain of radiation, so that the multi-band antenna can provide a broad range of services.

20 Claims, 9 Drawing Sheets

MINIATURIZED MULTI-BAND ANTENNA

BACKGROUND OF THE INVENTION

1. Field of the Invention

The present invention relates to an antenna, and more particularly, to a miniaturized multi-band antenna.

2. Description of the Prior Art

In a modern world of information, various wireless communication networks have become one of the most important channels for exchanging sounds, text, numerical results, data, and video for many people. An antenna is required to receive information carried by wireless electromagnetic waves in a wireless communications network. Therefore the development of antennas has also become one of key issues for vendors in the technology field. In order to have users implement and access information from different wireless networks in ease, an antenna with better design should be able to cover different bands of each wireless communications network with only one antenna. Besides, the size of the antenna should be as small as possible to be implemented in compact portable wireless devices (such as cellphones, Personal Digital Assistants i.e. PDAs).

In the prior art, Planar Inverted-F Antennas (PIFAs) are the most popular for wireless communication network transceiving services. Please refer to FIG. 1. FIG. 1 is a diagram of an antenna 10 that is a typical PIFA. A PIFA generally uses a planar radiation portion and a planar base to induce an electromagnetic wave oscillation. In addition, an antenna as shown in the R.O.C. patent publication number 200419843 (corresponding to U.S. Pat. No. 6,930,640) is also a type of PIFA. However, when using this type of antenna as a multi-band antenna, a planar radiation portion of the antenna requires a large planar area, and a distance between the radiation plane and a base plane of the antenna d0 (as in FIG. 1) is related to a frequency/bandwidth of the antenna that cannot be adjusted as desired. Thus, the antenna of the prior art cannot be structurally reduced in size and is unable to meet the needs of compactness and multi-band reception.

SUMMARY OF THE INVENTION

The claimed invention provides a multi-band antenna comprising a coupling portion installed on a first surface for feeding-in or feeding-out signals; a first radiation portion installed on a second surface crossing the first surface and coupled to the coupling portion, the first radiation portion comprising at least one section; and a second radiation portion installed on the second surface and coupled to the coupling portion, the second radiation portion comprising at least one section, wherein one section of the second radiation portion is parallel to one section of the first radiation portion and has an intercoupling with the first radiation portion; and a third radiation portion installed on the first surface and coupled to the coupling portion, the third radiation portion having an intercoupling with the first radiation portion and second radiation portion.

The claimed invention further provides a multi-band antenna comprising a coupling portion installed on a first surface for feeding-in or feeding-out signals; a first radiation portion installed on a second surface crossing the first surface and coupled to the coupling portion, the first radiation portion comprising at least one section; and a second radiation portion installed on the second surface and coupled to the coupling portion, the second radiation portion comprising at least one section, wherein one section of the second radiation portion is parallel to one section of the first radiation portion and has an intercoupling with the first radiation portion; and a third radiation portion installed above the first surface, the third radiation portion comprising a section coupled to the coupling portion, the third radiation portion having an intercoupling with the first radiation portion and second radiation portion.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
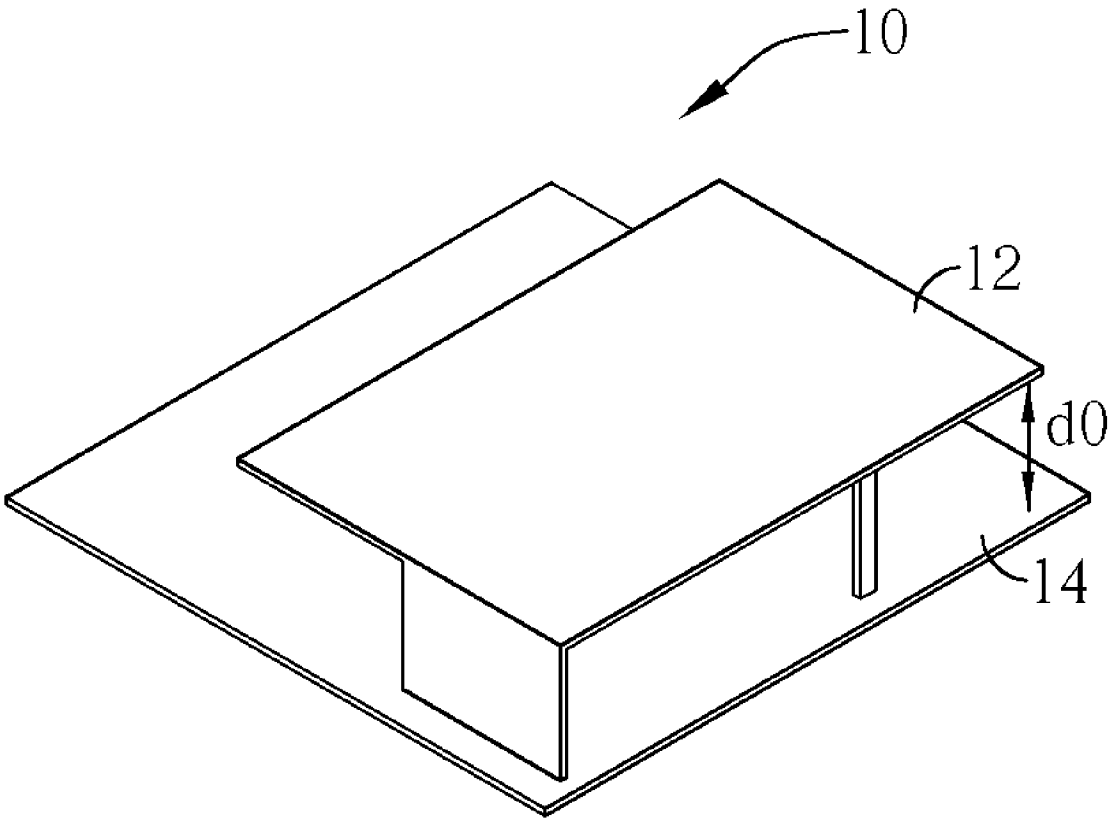
Fig. 1 Prior art
FIG. 1 is a diagram of an antenna of the prior art.
Figure 2:
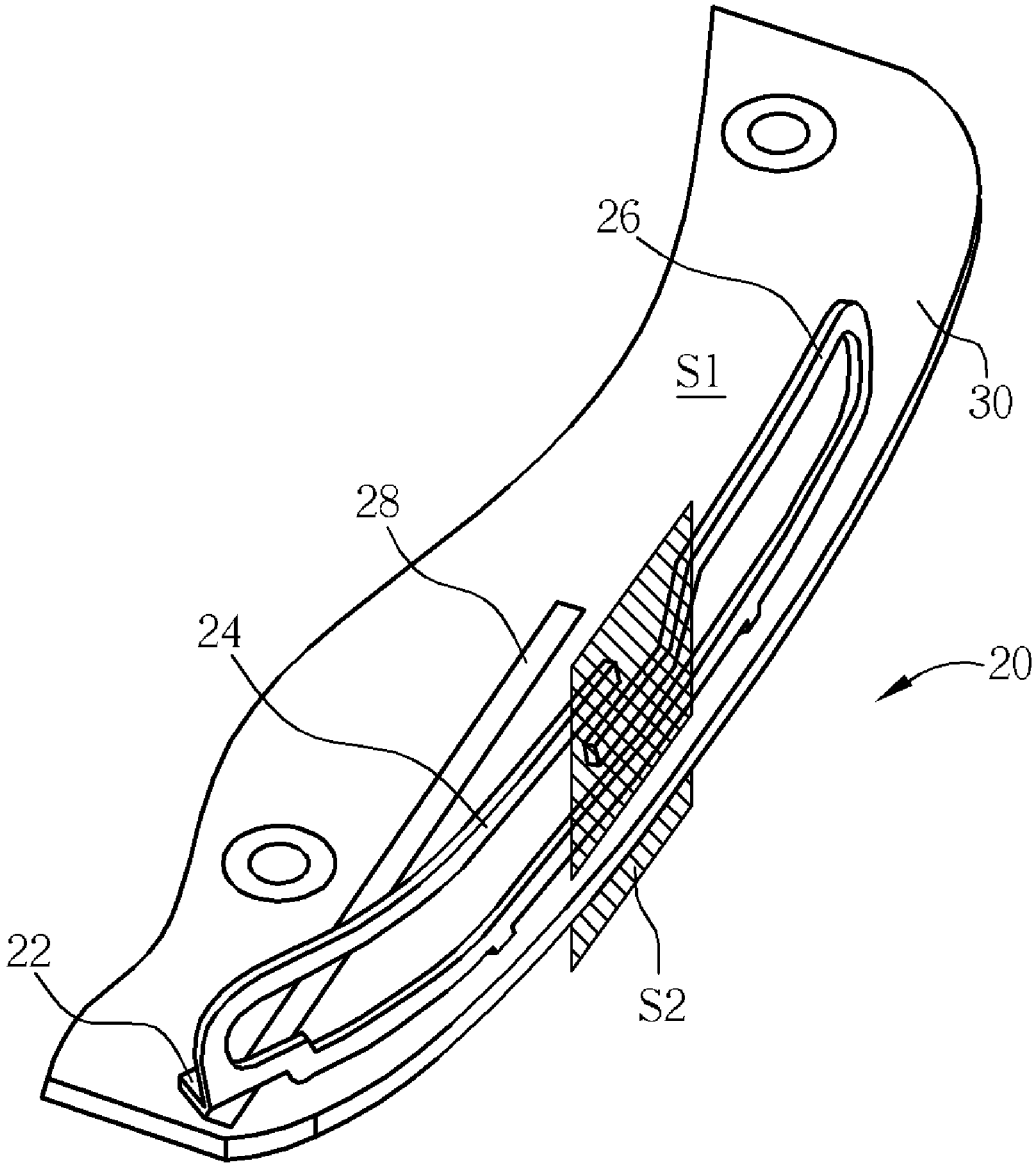
FIG. 2 is a view of a multi-band antenna of the first embodiment of the present invention.
Figure 3:
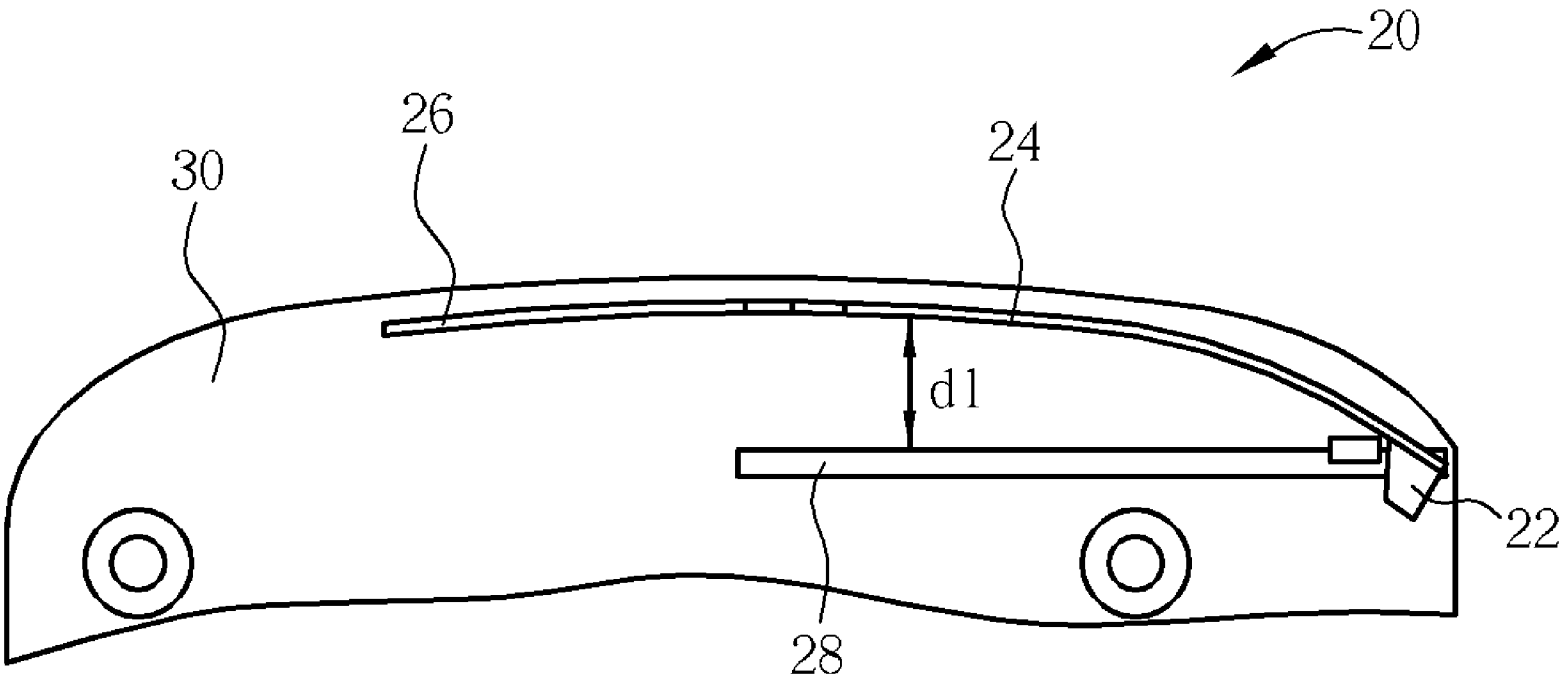
FIG. 3 is a top view of the antenna in FIG. 2.

Please refer to FIG. 2 and FIG. 3. FIG. 2 is a view of a multi-band antenna 20 of the first embodiment according to the present invention. FIG. 3 is a top view of the antenna 20 in FIG. 2. The antenna 20 comprises a coupling portion 22, a first radiation portion 24, a second radiation portion 26, and a third radiation portion 28. The coupling portion 22 is installed on a printed circuit board 30 for feeding-in or feeding-out signals. Assume that the printed circuit board 30 is a first surface S1. The first radiation portion 24 and the second radiation portion 26 are installed on a second surface S2 perpendicular to the first surface S1. The first radiation portion 24 and the second radiation portion 26 are coupled to the coupling portion 22. The first radiation portion 24 and the second radiation portion 26 comprise at least one section respectively, and one section of the first radiation portion 24 is parallel to one section of the second radiation portion 26 and has an intercoupling with the second radiation portion 26. The third radiation portion 28 is installed on the printed circuit board 30 and coupled to the coupling portion 22. The third radiation portion has an intercoupling with the first radiation portion 24 and the second radiation portion 26. The first radiation portion 24 and the second radiation portion 26 of the antenna 20 uses a stamped metal with the width 1.0 mm to form a radiation surface S2 installed vertically on the printed circuit board 30. In low frequency bands, such as GSM (Global System for Mobile communication)–850/900 (824~960 MHz), the second radiation portion 26 has a longer metal length so as to radiate electromagnetic waves in low frequency bands. In high frequency bands, such as GSM-1800/1900 (1710~1990 MHz), GPS (Global Positioning System) (1575±1.1 MHz), the first radiation portion 24 has a shorter metal length so as to radiate electromagnetic waves in high frequency bands. In addition, the third radiation portion 28 installed on the printed circuit board 30 is an auxiliary antenna, which is coupled to the radiation surface S2 via the coupling portion 22. The auxiliary antenna can radiate electromagnetic waves in higher frequency bands, such as WCDMA (Wide-band Code-Division Multiple Access)—2100 (1920~2170 MHz). As shown in FIG. 3, the distance dl between the third radiation portion 28 and the radiation surface S2 (the first radiation portion 24 and the second radiation portion 26) can be adjusted so that the third radiation portion 28 has an intercoupling with the radiation surface S2 to generate the required bandwidth. Thus, the antenna 20 can provide a broad range of services including GSM-850/900, GSM-1800/1900, 3G, WCDMA-2100, UMTS (Universal Mobile Telecommunications System)-2100 (1940~2170 MHz), and GPS.

Figure 4:
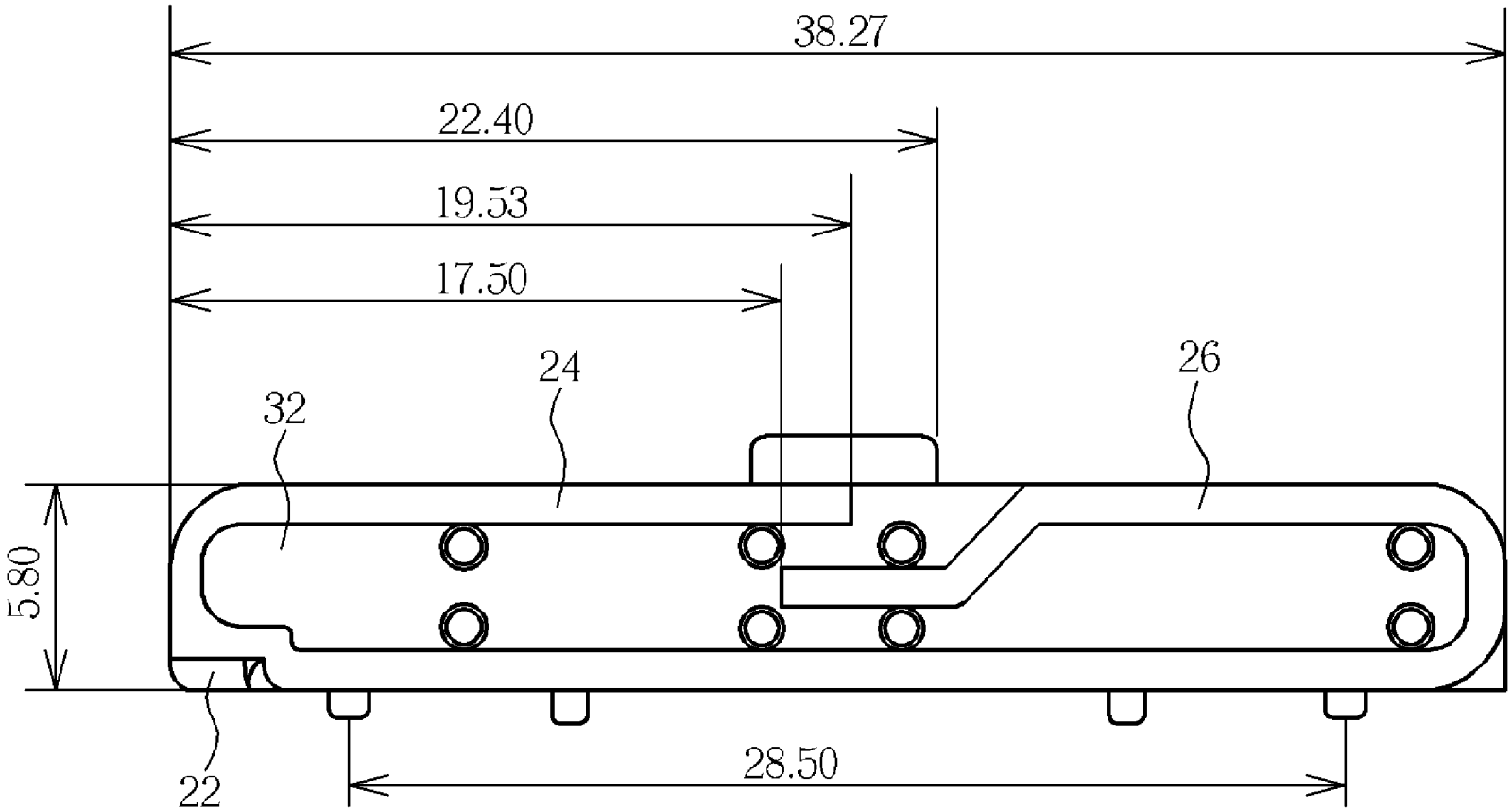
FIG. 4 is a front view of the antenna in FIG. 2.

Please refer to FIG. 4. FIG. 4 is a front view of the antenna 20 in FIG. 2. In practice, the first radiation portion 24 and the second radiation portion 26 are fixed with a fixture 32. In addition, FIG. 4 shows the size of the first radiation portion 24 and the second radiation portion 26. The unit is mm. The fixture 32 can be a medium material (i.e. a non-conductive material such as plastic etc.). The fixture 32 comprises various holes and rails to fit with the first radiation portion 24 and the second radiation portion 26. When the fixture 32, the first radiation portion 24, and the second radiation portion 26 are fixed together, the combination can be easily placed on the circuit board 30 because the fixture 32 can comprise tenons, screw holes etc. to have the combination fixed on the circuit board 30. The fixture 32 not only fixes or protects the first radiation portion 24 and the second radiation portion 26, but also can be used as a supporting pole for other communications devices. The material of the fixture 32 can affect the characteristics of the antenna 20. However, the distance d1 between the third radiation portion 28 and the radiation surface S2 can be adjusted to fine-tune the characteristics and compensate effects of the fixture 32. In reverse, the characteristics or other radiation characteristics of the antenna 20 can also be adjusted, varied through tuning or changing the medium material of the fixture 32.

In the first embodiment, the antenna 20 can be formed with the stamped metal, or bended conductors having uniform cross sections. Further, coupling portion 22, the first radiation portion 24, and the second radiation portion 26 can be formed with a single conductor, and the third radiation portion 28 can be printed directly on the printed circuited board 30 so that costs can be saved.

Figure 5:
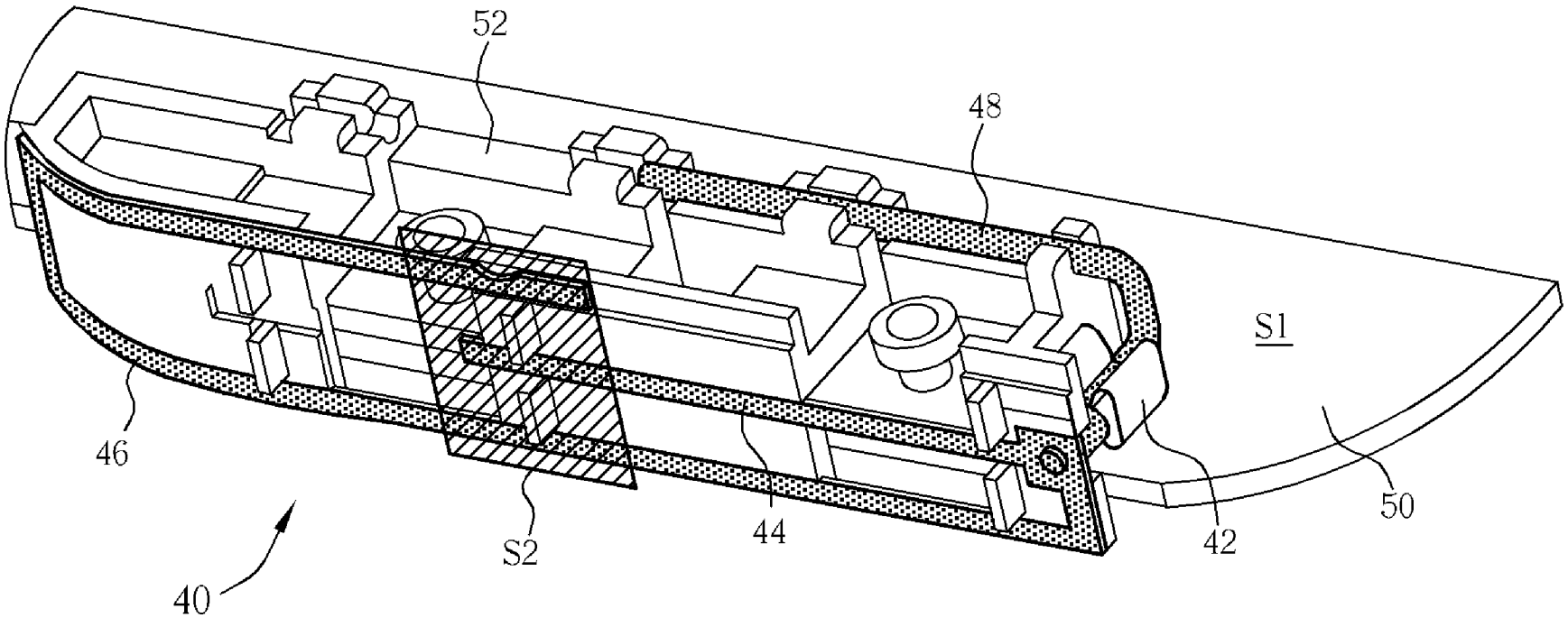
FIG. 5 is a view of a multi-band antenna of the second embodiment of the present invention.

Please refer to FIG. 5. FIG. 5 is a view of a multi-band antenna 40 of the second embodiment according to the present invention. The antenna 40 comprises a coupling portion 42, a first radiation portion 44, a second radiation portion 46, and a third radiation portion 48. The coupling portion 42 is installed on a printed circuit board 50 for feeding-in or feeding-out signals. Assume that the printed circuit board 50 is a first surface S1. The first radiation portion 44 and the second radiation portion 46 are installed on a second surface S2 perpendicular to the first surface S1. The first radiation portion 44 and the second radiation portion 46 are coupled to the coupling portion 42. The second surface can be designed as a curved surface to fit the housing of the communication device. The first radiation portion 44 and the second radiation portion 46 comprise at least one section respectively, and one section of the first radiation portion 44 is parallel to one section of the second radiation portion 46 and has an intercoupling with the second radiation portion 46. The third radiation portion 48 is installed above the printed circuit board 50. The third radiation portion 48 is an L-shaped cylindrical conductor, the short section of the third radiation portion 48 is coupled to the coupling portion 42, and the long section of the third radiation portion 48 is parallel to one section of the first radiation portion 44. The first radiation portion 44 and the second radiation portion 46 of the antenna 40 use a stamped metal with the width of 1.0 mm to form a radiation surface S2 installed vertically on the printed circuit board 30. In low frequency bands, such as GSM-850/900 (824~960 MHz), the second radiation portion 46 has a longer metal length so as to radiate electromagnetic waves in low frequency bands. In high frequency bands, such as GSM-1800/1900 (1710~1990 MHz), GPS (1575±1.1 MHz), the first radiation portion 24 has a shorter metal length so as to radiate electromagnetic waves in high frequency bands. In addition, the L-shaped third radiation portion 28 is installed above the printed circuit board 30 to form an auxiliary antenna. The short section of the third radiation portion 48 is coupled to the radiation surface S2 via the coupling portion 22. The third radiation portion 48 has an intercoupling with the first radiation portion 44 and the second radiation portion 46. The auxiliary antenna can radiate electromagnetic waves in higher frequency bands, such as WCDMA (Wide-band Code-Division Multiple Access)-2100 (1920~2170 MHz).

In the second embodiment, the first radiation portion 44, the second radiation portion 46, and the third radiation portion 48 are fixed with a fixture 52 on the printed circuit board 50. The fixture 52 can be a medium material (i.e. a non-conductive material such as plastic etc.). The fixture 52 comprises various holes and rails to fit with the first radiation portion 44 and the second radiation portion 46, and further comprises a groove to support the third radiation portion 48. When the fixture 52, the first radiation portion 44, the second radiation portion 46, and the third radiation portion 48 are fixed together, the combination can be easily placed on the circuit board 50 because the fixture 52 can comprise tenons, screw holes etc. to have the combination fixed on the circuit board 50. The fixture 52 not only fixes or protects the first radiation portion 44, the second radiation portion 46, and the third radiation portion 48, but also can be used as a supporting pole for other communications devices. In the embodiment, the first radiation portion 44 and the second radiation portion 46 use a stamped metal, and the third radiation portion 48 uses a cylindrical conductor. The first radiation portion 44, the second radiation portion 46, and the third radiation portion 48 are coupled via the coupling portion 42, so the relative positions of the first radiation portion 44, the second radiation portion 46, and the third radiation portion 48 can be easily adjusted to find the best frequency bands of the antenna 40.

Figure 6:
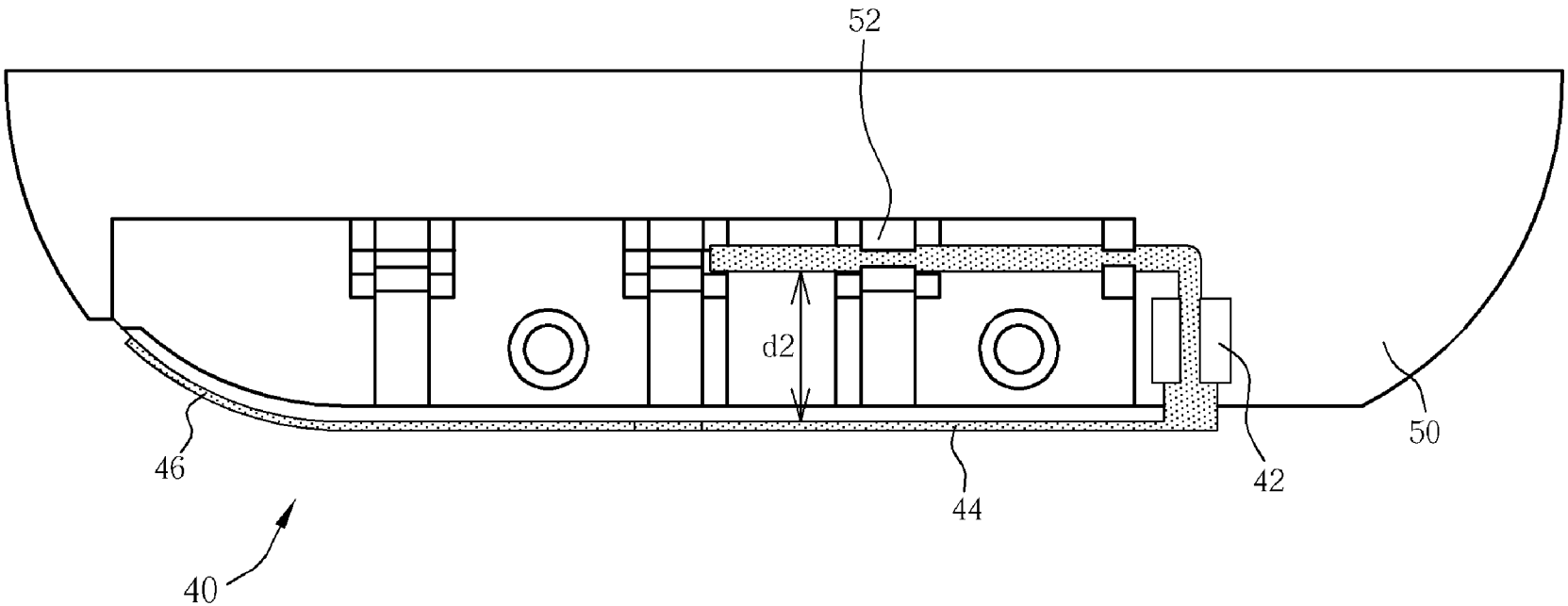
FIG. 6 is a top view of the antenna in FIG. 5.
Figure 7:
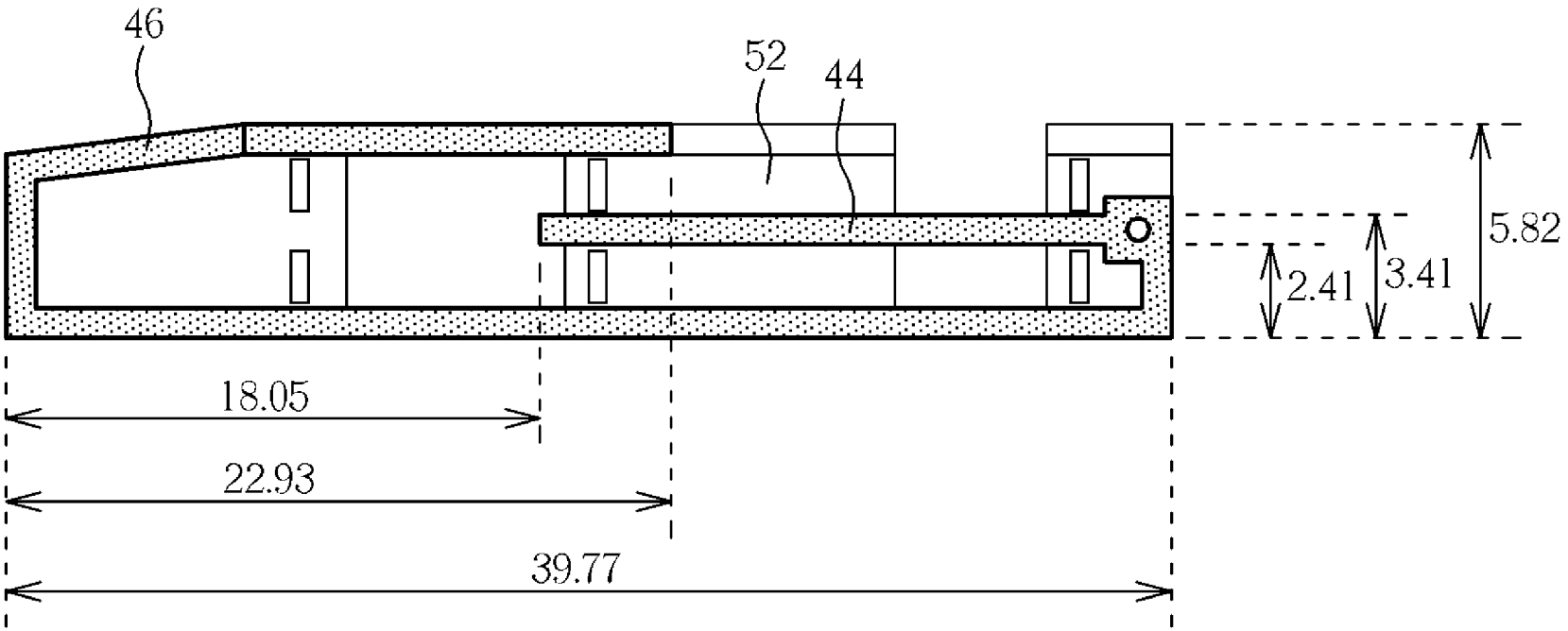
FIG. 7 is a front view of the antenna in FIG. 5.

Please refer to FIG. 6 and FIG. 7. FIG. 6 is a top view of the antenna 40 in FIG. 5. FIG. 7 is a front view of the antenna 40 in FIG. 5. The distance d2 between the third radiation portion 48 and the radiation surface S2 (the first radiation portion 44 and the second radiation portion 46) can be adjusted so that the third radiation portion 48 has an intercoupling with the radiation surface S2 to generate the required bandwidth. Thus, the antenna 40 can provide a broad range of services including GSM-850/900, GSM-1800/1900, 3 G, WCDMA-2100, UMTS (Universal Mobile Telecommunications System)-2100 (1940~2170 MHz), and GPS. In addition, the distance d2 between the third radiation portion 48 and the radiation surface S2 can be adjusted to fine-tune the characteristics and compensate effects of the fixture 52. In reverse, the characteristics or other radiation characteristics of the antenna 40 can also be adjusted, varied through tuning or changing the medium material of the fixture 52. FIG. 7 shows the size of the first radiation portion 44 and the second radiation portion 46. The unit is mm.

Figure 8:
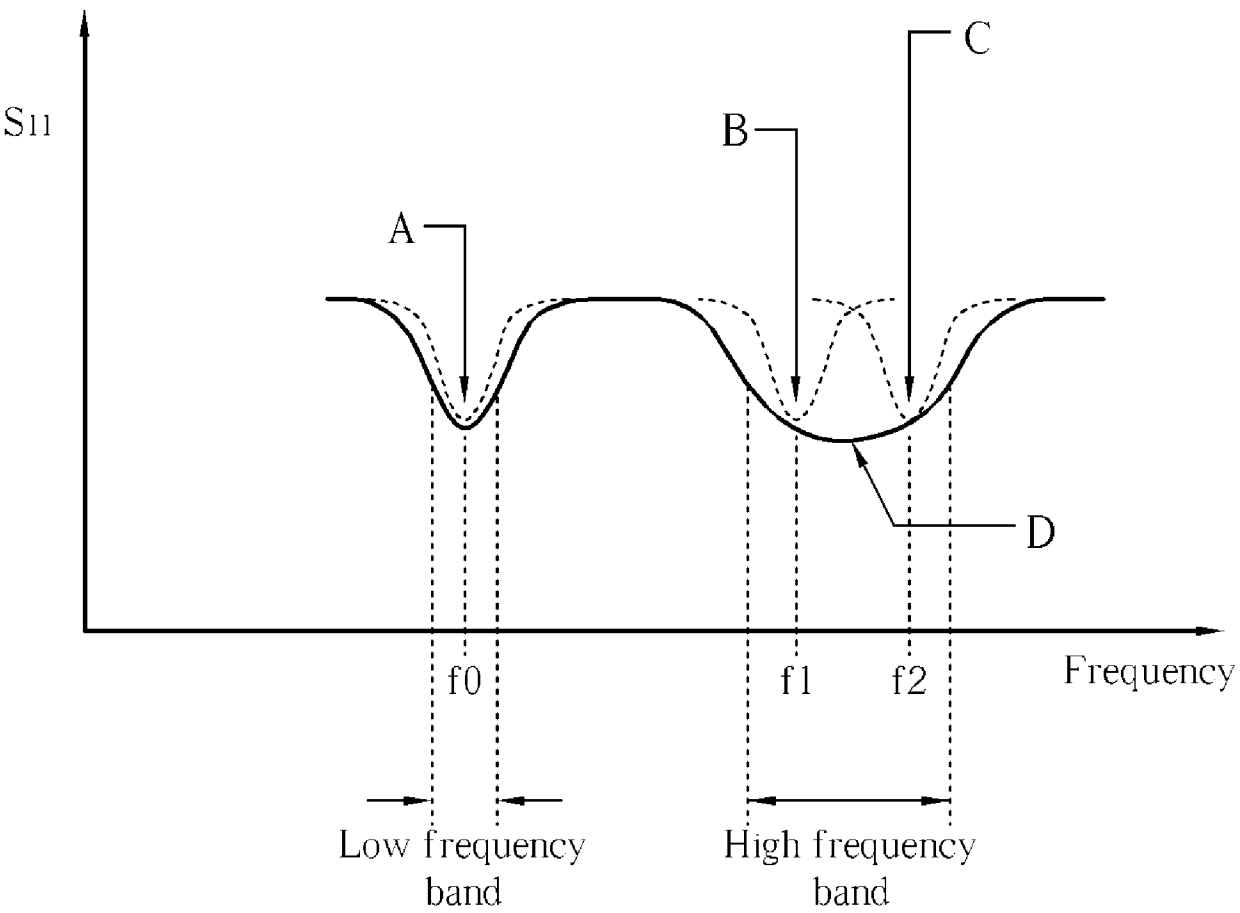
FIG. 8 illustrates the theory of couplings between the low and high frequency radiation portions in a frequency spectrum according to the characteristics of the present invention.

Please refer to FIG. 8. FIG. 8 illustrates the theory of couplings between the low and high frequency radiation portions in a frequency spectrum according to the characteristics of the present invention. The horizontal axis represents frequency and the vertical axis represents frequency spectrum characteristics. For instance, the vertical axis can be VSWR (Voltage Standing Wave Ratio) or parameter S11 of the return-loss. For people who are familiar with the technique, a local minimum of the return-loss S11 in a spectrum can represent a usable bandwidth of an antenna, so the return-loss S11 is usually used to show a radiation characteristic of an antenna, especially in a frequency spectrum. If only the low frequency radiation portion is considered, the low frequency radiation portion of the antenna with a longer length induces a low frequency local minimum (indicator A, shown with a broken line) at a low frequency band (i.e. around frequency f0). Similarly, taking only the high frequency radiation portion into account, with a shorter high frequency radiation portion, the antenna induces a high frequency local minimum (indicator C, shown with a broken line) around a frequency f2 at a high frequency band. In general, a bandwidth of the high frequency band can simultaneously support different working bands required by different high frequency communications (2 G/3 G applications). However, as discussed earlier, the antenna of the present invention is especially designed to have a stronger coupling between the low and the high frequency radiation portions, so overall characteristics of the antenna are improved with the intercoupling. The intercoupling causes two effects. First, the intercoupling promotes coupling of harmonics of the low frequency radiation portion and hence induces a local minimum at a harmonic frequency. Secondly, a second harmonic of the low frequency radiation portion can induce another local minimum (indicator B, shown with a broken line) at a frequency f1, which means that the frequency f1 is about twice of the frequency f0, and this helps expand usable bandwidth of the high frequency band. Further, the intercoupling between the low and high frequency radiation portions can also produce equivalent intercoupled or autocoupled inductances and capacitances between each section. The inductance and capacitance lower a Q factor of the antenna accordingly increase or decrease bandwidth of frequency spectrum of the antenna. As the Q factor gets larger, the bandwidth gets smaller. Hence the decrease in Q factor reflects on the spectrum as the increase in bandwidth. As curves (indicator D) shown in FIG. 8, since the present invention increases bandwidth with intercoupling effects, the local minimums at frequencies f1 and f2 can expand while the Q factor decreases and combine with each other to form a usable band of high frequency and to fulfill requirements of different wireless communication networks.

Figure 9:
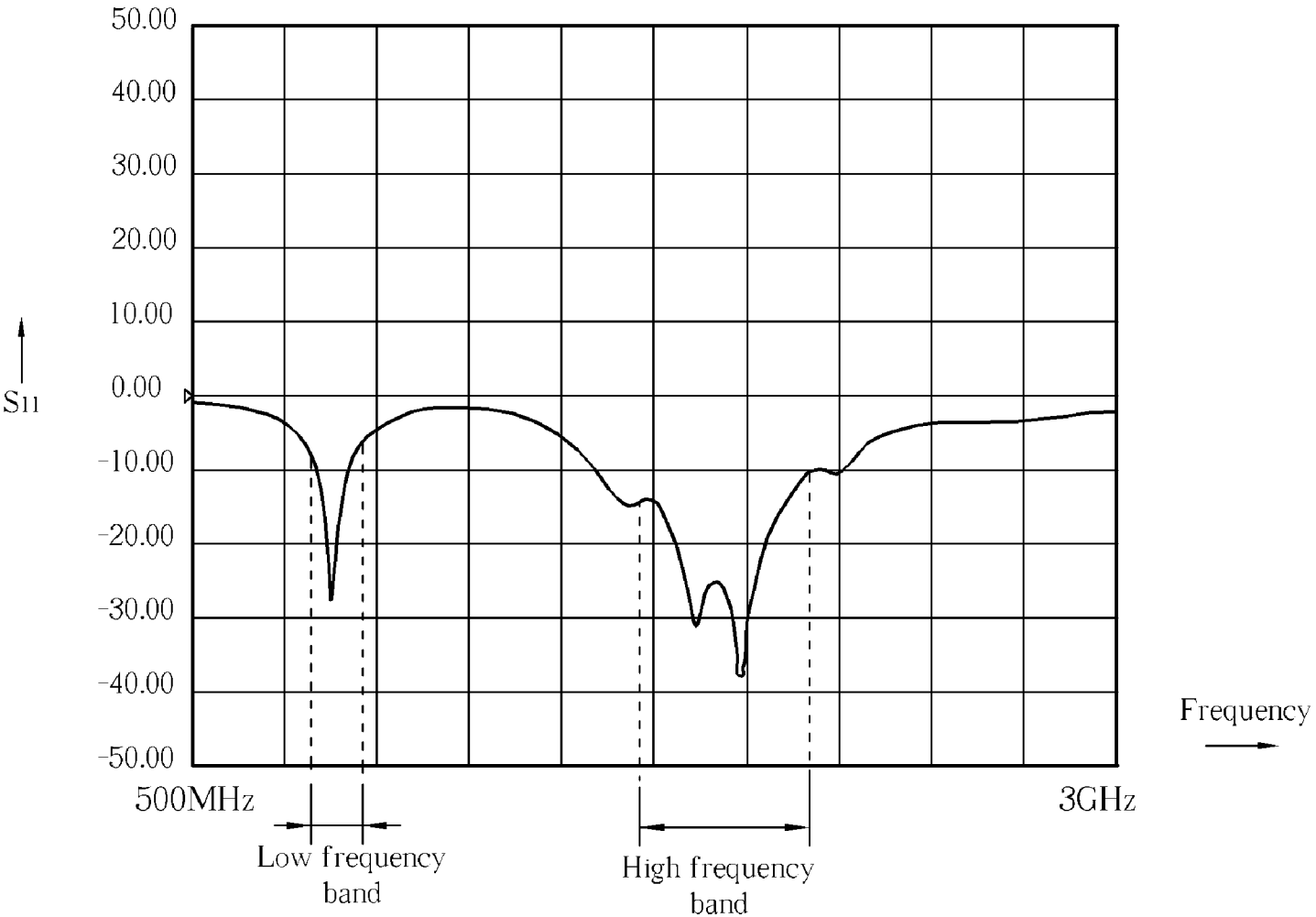
FIG. 9 shows a frequency spectrum characteristic of the antenna according to the present invention.

Please refer to FIG. 9. FIG. 9 shows a frequency spectrum characteristic of the antenna according to the present invention. The horizontal axis represents frequency and the vertical axis represents return-loss S11. With the antenna structure design according to the present invention, the frequency spectrum characteristic as shown in FIG. 8 can be practiced. From FIG. 9, the antenna supports GSM-850/900 in low frequency band while covering GSM-1800/1900 and UMTS 2100 in the high frequency wideband. With only one antenna, multiple different bands from different wireless communications requirements are met; therefore a multi-band antenna is achieved. Further, the distance between the third radiation portion and the radiation surface can be easily adjusted for expanding usable bandwidth of the high frequency band to support GPS, GSM-1800/1900, and WCDMA-2100/UMTS-2100.

In conclusion, the size of the antenna should be as small as possible to be implemented in compact portable wireless devices. According to the present invention, a multi-band antenna includes a bent flat copper antenna forming a radiation surface to provide GSM-850/900/1800/1900 or GPS multi-band applications, and an auxiliary antenna coupled to the radiation surface to provide WCDMA-2100/UMTS-2100 multi-band applications. The radiation surface and the auxiliary antenna are coupled to generate the required bandwidth for multiple radiation bands and to optimize the gain of radiation, so that the multi-band antenna can provide a broad range of services. Thus, the antenna according to the present invention can support different working bands required by different high frequency communications (2 G/3 G applications) and be implemented in compact portable wireless devices.

Those skilled in the art will readily observe that numerous modifications and alterations of the device and method may be made while retaining the teachings of the invention.

What is claimed is:

1. A multi-band antenna comprising:

a coupling portion installed on a first surface for feeding-in or feeding-out signals;

a first radiation portion installed on a second surface crossing the first surface and coupled to the coupling portion, the first radiation portion comprising at least one section;

a second radiation portion installed on the second surface and coupled to the coupling portion, the second radiation portion comprising at least one section, wherein one section of the second radiation portion is parallel to one section of the first radiation portion and has an intercoupling with the first radiation portion; and a third radiation portion installed on the first surface and coupled to the coupling portion, the third radiation portion having an intercoupling with the first radiation portion and second radiation portion.

2. The multi-band antenna of claim 1 wherein the second radiation portion and the first radiation portion are at a same side of the first surface.

3. The multi-band antenna of claim 1 wherein the second surface is perpendicular to the first surface.

4. The multi-band antenna of claim 1 wherein the second surface is a curved surface.

5. The multi-band antenna of claim 1 wherein the third radiation portion have the intercoupling with one section of the first radiation portion and one section of the second radiation portion.

6. The multi-band antenna of claim 1 further comprising a printed circuit board, wherein the coupling portion is a metal contact formed on the printed circuit board, and the third radiation portion is a metal line formed on the printed circuit board.

7. The multi-band antenna of claim 6 further comprising a fixture installed on the printed circuit board, wherein the first radiation portion and the second radiation portion are installed on the fixture.

8. The multi-band antenna of claim 1 wherein the first radiation portion is used for radiating electromagnetic waves in high frequency bands, and the second radiation portion is used for radiating electromagnetic waves in low frequency bands.

9. The multi-band antenna of claim 1 wherein the first radiation portion and the second radiation portion are formed of stamped metals.

10. A multi-band antenna comprising:

a coupling portion installed on a first surface for feeding-in or feeding-out signals;

a first radiation portion installed on a second surface crossing the first surface and coupled to the coupling portion, the first radiation portion comprising at least one section;

a second radiation portion installed on the second surface and coupled to the coupling portion, the second radiation portion comprising at least one section, wherein one section of the second radiation portion is parallel to one section of the first radiation portion and has an intercoupling with the first radiation portion; and a third radiation portion installed above the first surface, the third radiation portion comprising a section coupled to the coupling portion, the third radiation portion having the intercoupling with the first radiation portion and second radiation portion.

11. The multi-band antenna of claim 10 wherein the second radiation portion and the first radiation portion are at a same side of the first surface.

12. The multi-band antenna of claim 10 wherein the second surface is perpendicular to the first surface.

13. The multi-band antenna of claim 10 wherein the second surface is a curved surface.

14. The multi-band antenna of claim 10 wherein the third radiation portion have the intercoupling with one section of the first radiation portion and one section of the second radiation portion.

15. The multi-band antenna of claim 10 further comprising a printed circuit board, wherein the coupling portion is a metal contact formed on the printed circuit board.

16. The multi-band antenna of claim 15 further comprising a fixture installed on the printed circuit board, wherein the first radiation portion, the second radiation portion and the third radiation portion are installed on the fixture.

17. The multi-band antenna of claim 10 wherein the first radiation portion is used for radiating electromagnetic waves in high frequency bands, and the second radiation portion is used for radiating electromagnetic waves in low frequency bands.

18. The multi-band antenna of claim 10 wherein the first radiation portion and the second radiation portion are formed of stamped metals.

19. The multi-band antenna of claim 10 wherein the third radiation portion is an L-shaped cylindrical conductor, a short section of the third radiation portion is coupled to the coupling portion, and a long section of the third radiation portion has an intercoupling with the first radiation portion and the second radiation portion.

20. The multi-band antenna of claim 10 wherein the third radiation portion is parallel to the first surface and one section of the first radiation portion.

* * * * *